US006062836A

United States Patent [19]

Jülicher et al.

[11] Patent Number: 6,062,836

[45] Date of Patent: May 16, 2000

[54] GEAR PUMP

[75] Inventors: Wilhelm Jülicher, Köln; Gerald Gaumitz, Leverkusen; Gert Huppertz, Erkrath, all of Germany

[73] Assignee: Agfa-Gavaert N.V., Belgium

[21] Appl. No.: 09/004,440

[22] Filed: Jan. 9, 1998

[30] Foreign Application Priority Data

Jan. 16, 1997 [DE] Germany ..... 197 01 276

[51] Int. Cl.[7] ..... F01C 21/00

[52] U.S. Cl. ..... 418/77; 418/206.1; 418/79

[58] Field of Search ..... 418/206.1, 77, 418/79

[56] References Cited

U.S. PATENT DOCUMENTS

| | | | |
|---|---|---|---|
| 1,348,773 | 8/1920 | Auger | 418/79 |
| 2,885,965 | 5/1959 | Haberland | 418/79 |
| 2,997,960 | 8/1961 | Kimjima et al. | 418/79 |
| 3,063,378 | 11/1962 | Hart | 418/79 |
| 3,833,317 | 9/1974 | Rumsey | 418/79 |
| 4,770,617 | 9/1988 | Hertell | 418/79 |

FOREIGN PATENT DOCUMENTS

| | | | |
|---|---|---|---|
| 0 625 641 A2 | 11/1994 | European Pat. Off. . | |
| 1 528 823 | 10/1972 | Germany . | |
| 627561 | 2/1946 | United Kingdom | 418/79 |
| 669886 | 4/1952 | United Kingdom | 418/79 |
| 739357 | 1/1954 | United Kingdom | 418/79 |
| 872946 | 11/1957 | United Kingdom | 418/79 |

*Primary Examiner*—Thomas Denion
*Assistant Examiner*—Theresa Trieu
*Attorney, Agent, or Firm*—Connolly Bove Lodge & Hutz

[57] ABSTRACT

A gear pump comprising two gearwheels moving in opposite senses, the gears whereof engage with one another and thus, separated from one another in a pressure-tight manner, form a delivery side and a suction side; a central plate wherein the gearwheels are accommodated; a front and rear covering plate, which seal the gear pump from the environment, and conventional means of connecting the plates with one another, of supporting the gearwheels, of driving at least one of the gearwheels and of supplying and removing the liquid being pumped, during the delivery of silver halide emulsions exhibits no silver deposits—which bring the pump to a halt—on its faces, if on each face of each gearwheel there is provided at least one indentation having a sharp rear edge viewed in the direction of rotation.

3 Claims, 1 Drawing Sheet

GEAR PUMP

BACKGROUND OF THE INVENTION

The present invention relates to a gear pump which is particularly suitable for the delivery of liquids which give rise to deposits within the pump, in particular on the faces of the gearwheels.

The delivery of silver halide emulsions for photographic materials, and in particular their accurate metering, by means of gear pumps is known from EP-A 0 625 641. It is also known that in the course of the operation metallic silver is deposited, in particular between the faces of the gearwheels and the front and rear covering plate, as quite a narrow gap is provided here in order that the gearwheels can rotate within the housing of the gear pump, which is formed inter alia by the front and rear covering plates (see exploded drawing in EP-A 0 625 641).

According to prior art, the deposition of silver is caused by electrolysis of the silver halide emulsion and can be avoided if the parts of the pump which come into contact with the silver halide emulsion are composed of cobalt alloys of the type referred to as "stellite".

Long-term tests have shown that an effective prevention of the deposition of silver is not successfully achieved in this way.

When the deposited layer of silver has attained a certain thickness, determined by the gap width between the faces of the gearwheels and the covering plates, the driving motor is no longer capable of rotating the gearwheels and comes to a halt. Apart from mechanical damage, there is also a halt to the production.

SUMMARY OF THE INVENTION

The object of this invention was to extend considerably the operating times of a gear pump, which are shortened as a result of the deposition of silver.

It has now surprisingly been found that this is achieved when both faces of both the gearwheels of a gear pump are each provided with at least one indentation having a sharp rear edge viewed in the direction of rotation.

The invention accordingly provides a gear pump comprising two gearwheels moving in opposite senses, the gears whereof engage with one another and thus, separated from one another in a pressure-tight manner, form a delivery side and a suction side; a central plate wherein the gearwheels are accommodated; a front and rear covering plate, which seal the gear pump from the environment, and conventional means of connecting the plates with one another, of supporting the gearwheels, of driving at least one of the gearwheels and of supplying and removing the liquid being pumped, characterised in that on each face of each gearwheel there is provided at least one indentation having a sharp rear edge viewed in the direction of rotation.

DETAILED DESCRIPTION OF THE INVENTION

Figure 1:
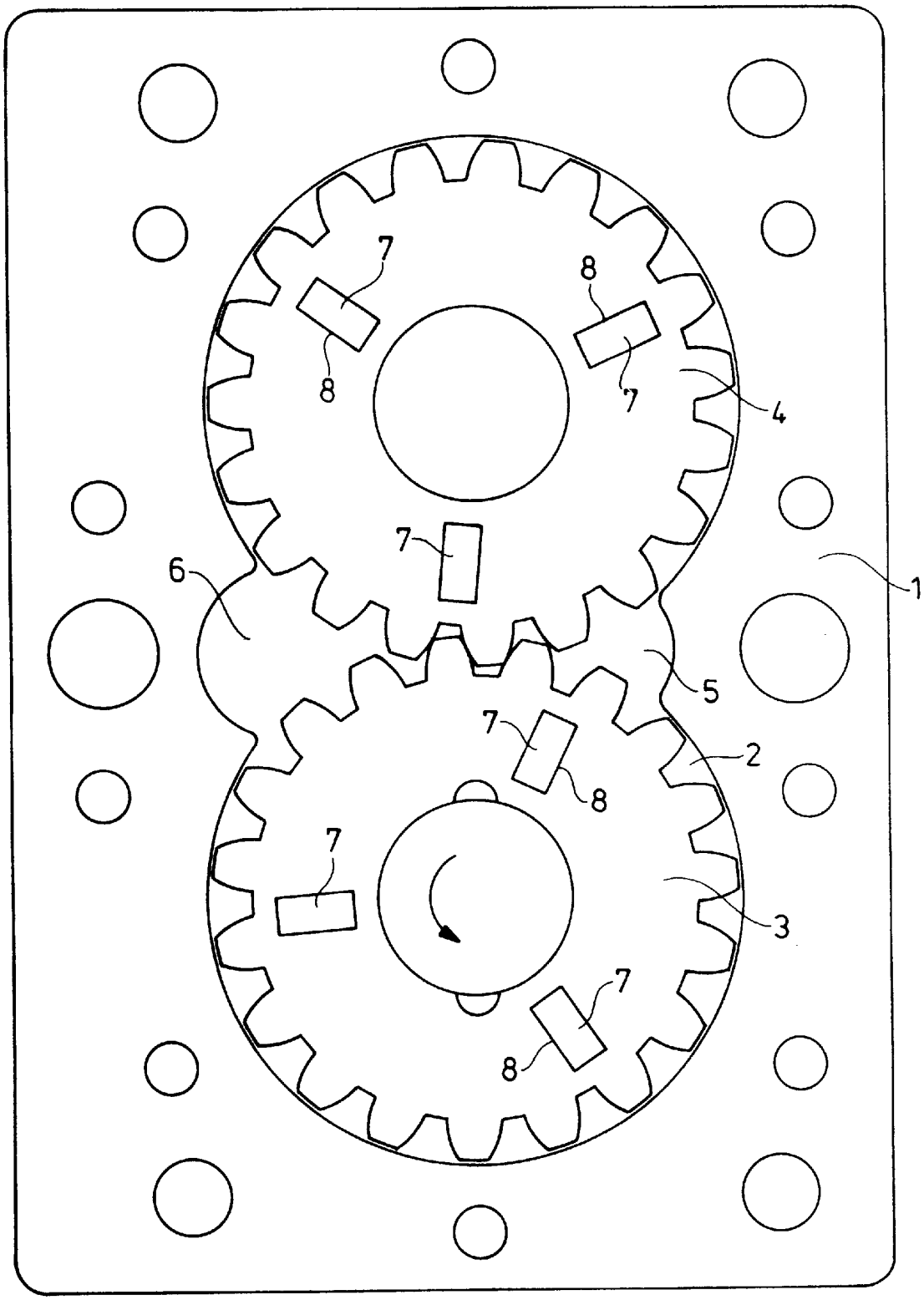
FIG. 1 shows a top view of a gear pump according to the invention, with the front covering plate removed.

The central plate 1 encloses the space 2 wherein the gearwheels 3 and 4 move and form the delivery space 5 and the suction space 6. The gearwheel 3 is driven in the direction of the arrow; the gearwheel 4 rotates with it, in the opposite sense. The indentations 7 in the form of narrow grooves, the rear edge 8 whereof is sharp, are located on the faces of the gearwheels.

The remainder of the design and the number of indentations is not significant. Simple geometric shapes and a rotationally symmetrical mounting are however recommended in order to avoid raising the production costs unnecessarily and not to give cause for an uneven force, if only slight.

The rear edge 8 may, as indicated, be straight and lie along a radius, but may also diverge from this. The indentation may be of equal depth in all places or diverge from this; it may, for example, become progressively deeper from the front edge to the rear edge, which facilitates its production. It should extend towards the circumference of the gearwheel as far as possible up to the base of the gear or even into the gear. An extension up to the axis of rotation is possible, but not absolutely necessary, as hardly any deposits of silver are found here.

The gear pump according to the invention has substantially longer operating times than those of a gear pump without indentations in the faces. When the pump routinely comes to a halt, smaller or larger deposits of silver are found in the indentations, depending on the period of use and the silver halide emulsion delivered. These deposits of silver can be easily removed and led away for reuse.

The faces themselves are virtually free from silver.

EXAMPLE 1

A silver halide/gelatine emulsion having a viscosity $\eta$=27 mPa –s and an Ag content of 18 g/l was delivered by means of a gear pump of the type shown in FIG. 1 without indentations 7. The pump was operated at 75 rev/min at a back pressure of between 0.3 and 2 bar. The volume delivered was 216 1/h.

The current consumption of the driving motor was initially 2.5 A and increased after about 90 hours to over 3.5 A. A little later the pump came to a halt. During the disassembly, deposits of silver were found on the faces and on other parts of the pump.

EXAMPLE 2

Example 1 was repeated using a gear pump of the type shown in FIG. 1 having rectangular indentations 7. The pump used had three indentations spaced evenly on each face, which were 6 mm wide, 15 mm long and 6 mm deep and had sharp edges 8.

The current consumption of the driving motor was consistently 2.5 to 3 A. The pump ran free from disturbances for more than 300 hours and was then disassembled. Deposits of silver were found only in the indentations 7; the faces remained free from silver.

What is claimed is:

1. A gear pump comprising two gearwheels rotating in opposite directions, the gears whereof engage with one another and thus, separated from one another in a pressure-tight manner, form a delivery side and a suction side; a central plate wherein the gearwheels are accommodated; front and rear covering plates, which seal the gear pump from the environment, and conventional means of connecting the plates with one another, of supporting the gearwheels, of driving at least one of the gearwheels and of supplying and removing the liquid being pumped, characterized in that on each face of each gearwheel there is provided at least one indentation having a sharp rear edge viewed in the direction of rotation, each indentation being spaced away from outer portions of the gearwheels and from spaces between the gearwheels and the central plate.

2. A gear pump according to claim 1 having on each face several indentations which have a simple geometric form and are arranged rotationally symmetrically on the faces.

3. A gear pump according to claim 1, wherein the rear edge is straight and lies along a radius of the gearwheel.

* * * * *